US005126187A

United States Patent [19]

Punton et al.

[11] Patent Number: 5,126,187

[45] Date of Patent: Jun. 30, 1992

[54] PHOTOGRAPHIC BASE PAPER

[75] Inventors: Vaughan W. Punton, Upton on Severn; Bronislaw Radvan, High Wycombe; George Tyler, Great Missenden, all of England

[73] Assignee: James River Graphics Limited, London, England

[21] Appl. No.: 764,061

[22] Filed: Sep. 24, 1991

[30] Foreign Application Priority Data

Feb. 17, 1987 [GB] United Kingdom ..... 8703627

[51] Int. Cl.[5] ..... G03C 1/775

[52] U.S. Cl. ..... 428/212; 428/211; 428/513; 428/535; 428/537.5; 430/271; 430/531; 430/538

[58] Field of Search ..... 428/211, 212, 535, 513, 428/537.5; 430/536, 538, 930, 271, 531

[56] References Cited

U.S. PATENT DOCUMENTS

| | | | |
|---|---|---|---|
| 812,204 | 2/1906 | Hoffsümmer | 430/538 |
| 3,885,962 | 5/1975 | MacClaren | 430/538 |
| 4,436,809 | 3/1984 | Akao et al. | 430/538 |
| 4,705,746 | 11/1987 | Tamagawa et al. | 430/538 |

FOREIGN PATENT DOCUMENTS

| | | | |
|---|---|---|---|
| 357453 | 12/1905 | France | 430/538 |
| 5918 | 7/1906 | France | 430/538 |
| 757902 | 1/1934 | France | 430/538 |
| 1225607 | 7/1960 | France | 430/538 |
| 971058 | 9/1964 | United Kingdom | 430/538 |
| 2177734 | 1/1987 | United Kingdom | 430/538 |

OTHER PUBLICATIONS

"Present and Future Trends in Multi-Ply Formers", Tappi, vol. 56, No. 12, pp. 129-133 (Dec. 1973).

*Primary Examiner*—Pamela R. Schwartz

*Attorney, Agent, or Firm*—Birch, Stewart, Kolasch & Birch

[57] ABSTRACT

Photographic base paper comprising a surface ply 1 of photographic grade paper and at least one backing ply 3 of a stronger paper such as a kraft paper provides smoothness and rigidity at least as good as conventional wholly photographic grade paper at reduced raw materials cost. Preferred weight of the surface ply is a range of from 20 to 50 $gm^{-2}$.

The paper can be made on a two-wire Fourdrinier machine (FIG. 5) or on a single wire machine with a secondary headbox (FIGS. 6 and 7).

13 Claims, 4 Drawing Sheets

PHOTOGRAPHIC BASE PAPER

This application is a continuation of application Ser. No. 07/418,999 filed on Oct. 10, 1989, now abandoned, which is a continuation of application Ser. No. 07/156,666 filed on Feb. 17, 1988, now abandoned.

BACKGROUND OF THE INVENTION

1. Field of the Invention

This invention relates to photographic base paper (often abbreviated to "photobase") and to methods of making such paper.

2. Background Art

Photographic base paper comprises a fibrous substrate which may be wholly cellulosic or may include a proportion of synthetic polymeric fibres. Typically, the base paper has a weight of around 150 g/m$^2$. To prepare the paper substrate for reception of a layer of photosensitive material e.g. photographic emulsion, the substrate is provided with a coating (usually a polyolefin or barium sulphate) on to which the emulsion is then itself coated. If a high gloss on the surface of the photographic emulsion is required, the surface of the emulsion is required to be extremely smooth.

The smoothness of the surface of the emulsion coating is largely determined by the smoothness of the surface of the underlying paper substrate, so the achievement of a smooth substrate is of critical importance. The requirement for smoothness is so high that most methods of measuring surface smoothness are not sufficiently sensitive to assess the suitability of a particular paper for making photographic prints and can only be used as an approximate guide. Visual assessment by skilled assessors is normally relied upon.

Typically, the photo-base paper-making "furnish" (that is, the pulp supplied to the headbox of the Fourdrinier paper-making wire) contains bleached softwood sulphite pulp and bleached hard-wood sulphite pulp, for example two parts of soft-wood to one of hard-wood, refined to a degree of wetness of twenty-five to thirty-five degrees on the Schopper-Riegler scale (25–35° SR). The paper is usually wet-strengthened with aminoplast resins and sized with natural or synthetic sizes and with starch. It may be calendered to a density of from 1.0 to 1.25.

Special pulps are chosen in order to achieve sufficient smoothness. The pulps in question are known as the "photographic" grades and are characterised by very high whiteness and brightness, the absence of dirt and chemical impurities, and by the content of soft and conformable fibres. Typically, such pulps have a high content of alpha cellulose and are made from soft woods by a slow and expensive digestion process. They are consequently expensive. Available sources for such pulps are well-known in the industry.

Some rigidity is highly desirable in photographic papers, but the soft and conformable nature of the component fibres, which provides the necessary surface smoothness, tends to limit the rigidity of the paper. A relatively rigid paper can better withstand the stresses which arise from the expansions and contractions of the photographic emulsion during its drying, and during frequent handling, and resist curling resulting from changes in ambient conditions.

An improvement in rigidity can be achieved, at the expense of smoothness, by modifying the kinds and/or treatment of the pulp used. Increasing the rigidity by increasing the thickness of the sheet is unacceptable since it renders the product photobase, and photosensitive papers made from it, difficult to handle, for example, in reels and cassettes. For wide acceptability, the weight of the photobase paper should lie within a range of from 140 to 165 gm$^{-2}$.

Thus, the simultaneous demands for extreme surface smoothness, and for rigidity, are mutually contradictory.

SUMMARY OF THE INVENTION

It is among the objects of the present invention to produce a photographic base paper having an acceptable degree of surface smoothness, but with improved rigidity and resistance to curl and/or which allows for the use of a wider selection of cheaper pulps without resort to an increase in the weight (the "grammage") of the product.

According to a first aspect of the present invention, there is provided a photographic base paper comprising a surface ply of photographic grade paper and at least one backing ply of a less expensive paper.

According to a second aspect of the present invention, there is provided a method of making photographic base paper comprising the steps of: delivering photographic grade paper pulp to a first headbox of a Fourdrinier paper-making machine; delivering a cheaper pulp to a second headbox of the machine; combining the outputs of the two headboxes into a web of at least two plies; and drying and coating the web.

Pulps made by an alkaline "sulphate" process, that is, the so-called "kraft" pulps, are normally stronger and harder than the sulphite pulps used for photographic grade paper. In one preferred embodiment of the present invention, the or each backing ply is of a kraft pulp.

The invention further extends to a photographic base paper as defined above, wherein the said surface ply is coated with a polyolefin, or a barium sulphate coating, and still further to such a coated paper, wherein the said coating has itself been coated with a photosensitive material, e.g. a photographic emulsion.

The invention provides increased flexibility in resolving the conflicting demands of surface smoothness and rigidity, and scope for reducing the requirement for the expensive soft pulp, thus reducing the overall cost of the paper.

Preferably, the weight (the "substance") of the surface ply is in a range of from twenty to fifty grams per square metre. It has surprisingly been found that, if the substance of the surface ply lies at the lower end of this range (i.e. from twenty to thirty grams per square metre), the surface smoothness of the multi-ply paper is actually improved as compared with a sheet of the same total grammage made entirely of the soft conformable pulp. In practice, however, a somewhat thicker surface ply will often be preferred, so the favoured range of weights is from 20 to 50 gm$^{-2}$.

BRIEF DESCRIPTION OF THE DRAWINGS

The invention will now be further described, by way of example, with reference to the accompanying drawings, in which.

DETAILED DESCRIPTION

Figure 1:
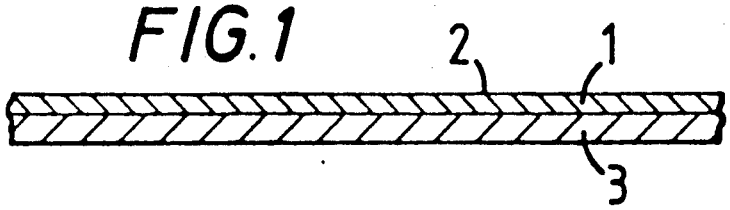
FIG. 1 is a cross-section of a substrate prepared according to the invention for the manufacture of a photographic base paper.
Figure 2:
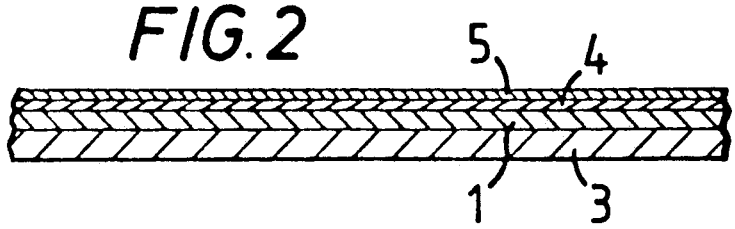
FIG. 2 is a cross-section on one form of sensitised photographic printing paper made from a substrate according to the invention.
Figure 3:
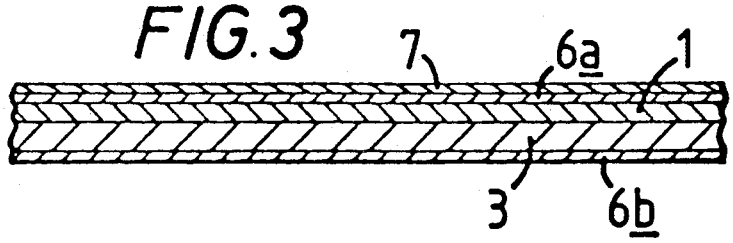
FIG. 3 is a cross-section of another form of photographic printing paper prepared from a substrate according to the invention.

Referring to FIGS. 1 to 3, the substrate shown in FIG. 1 comprises a surface ply 1 of soft conformable fibres which confer a high degree of smoothness at the surface 2. The surface ply 1 is formed on, and thereby integrated with, a backing ply 3 of harder stronger fibres which confers rigidity on the two-ply structure.

FIG. 2 shows a substrate of the kind shown in FIG. 1 but, coated in turn with a layer 4 of barium sulphate and a layer 5 of a photo-sensitive emulsion.

FIG. 3 shows a substrate of the kind shown in FIG. 1, coated on both sides with layers 6*a* and 6*b* of polyethylene. The layer 6*a* is further coated with a layer of photographic emulsion.

The invention will now be further illustrated with reference to the following Examples:

EXAMPLE 1

In this Example, individual single-ply and multiply sheets (so-called "handsheets") were produced and their surface smoothness and rigidity were compared.

The handsheets were made from two different types of pulp on a British standard sheet machine. Pulp A was a pulp used conventionally for making photographic base paper (photo-base) for resin coating. It contained about two parts of bleached softwood pulp and one part of bleached hardwood pulp and had a wetness of about 27° Schopper-Riegler (SR). Pulp B was a softwood fully-bleached "kraft" pulp (from Northwood mill). It had been beaten to a wetness of 19° SR. Handsheets of 55 g/m$^2$ and 170 g/m$^2$ were made from pulp A and handsheets of 55 g/m$^2$ were made from pulp B. The multi-ply sheets were made using three 55 g/m$^2$ sheets by transferring (couching) a first sheet from the paper-making wire onto blotting paper, couching a second sheet off the wire onto the first sheet and blotting paper and couching a third sheet off the wire using both the first and second sheets and the blotting paper. The sets of sheets were then pressed, dried and calendered to a density of about 1.0. Three types of sheet were obtained, as follows:

Set 1—single-ply sheets from pulp A of 170 g/m$^2$.

Set 2-3-ply sheets, each ply from pulp A and of 55 g/m$^2$.

Set 3—3-ply sheets, the top ply from pulp A and two lower plys from pulp B, all plys of 55 g/m$^2$.

Samples from each set were assessed for surface smoothness and tested for rigidity. Other samples from each set were coated with a film of polyethylene of 40 g/m$^2$ by passage through a melt-extrusion coater, and the surface smoothness of the coated sheets was assessed by a team of experienced assessors. The results are set out in Table 1 below.

TABLE 1

| Property | Units | Set 1 | Set 2 | Set 3 |
|---|---|---|---|---|
| Grammage (i.e. weight) | gm$^{-2}$ | 173 | 175 | 174 |

TABLE 1-continued

| Property | Units | Set 1 | Set 2 | Set 3 |
|---|---|---|---|---|
| Thickness (m) | m$^{-6}$ | 179 | 179 | 181 |
| Rigidity | Kenley | 1.8 | 2.2 | 2.8 |
| Smoothness (visual assessment after coating) | | satisfactory | poor | good |

EXAMPLE 2

In this Example, sets of 3-ply handsheets with differing proportions of the two pulps were made by the procedure set out in Example 1. In each case, 3-ply handsheets having a total grammage of 150 g/m$^2$ were produced, the handsheets of pulp A being produced at grammages of 10, 20, 30, 40 and 50 g/m$^2$, and a surface ply of one of these being teamed with two similar-weight, backing ply handsheets from pulp B of sufficient grammage to bring the 3-ply total up to 150 g/m$^2$.

Five types of 3-ply handsheets were obtained as in Table 2 below.

TABLE 2

| Set | Surface Ply (A) g/m$^2$ | Each Backing Ply (B) g/m$^2$ |
|---|---|---|
| S1 | 10 | 70 |
| S2 | 20 | 65 |
| S3 | 30 | 60 |
| S4 | 40 | 55 |
| S5 | 50 | 50 |

In addition, two further sets of sheets consisting entirely of pulp A were produced for comparative purposes. These were:

Set 6: single ply of 150 g/m$^2$.

Set 7: three plys each of 50 g/m$^2$.

Samples from each of the seven sets were coated with polyethylene to give a coating of grammage approximately 40 g/m$^2$. The coated samples were assessed by a team of experienced assessors and arranged in order of surface roughness. The results are shown in Table 3 below.

TABLE 3

| Smoothness Ranking R | Set | Comments |
|---|---|---|
| 1st | S2 | Very Good |
| 2nd | S3, S4 | Good |
| 3rd | — | — |
| 4th | S6 | Satisfactory |
| 5th | S5 | Satisfactory |
| 6th | S1 | Poor |
| 7th | S7 | Poor |

Figure 4:
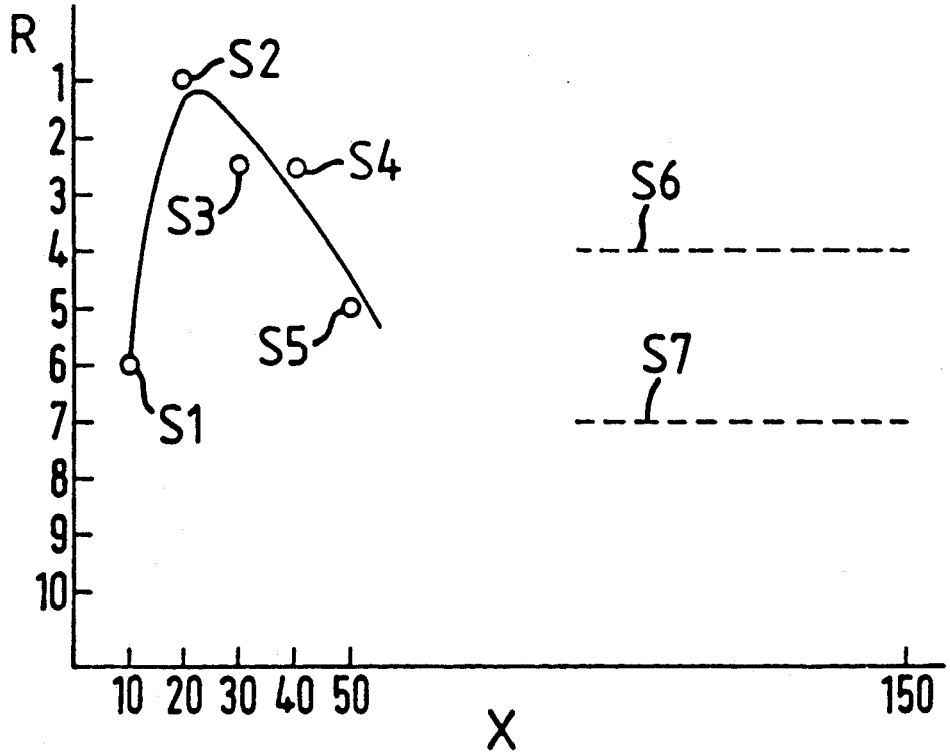
FIG. 4 is a graph showing how surface smoothness R varies with top layer thickness X.

From Table 3, it may be seen that the best results were obtained with samples having a surface ply of pulp A of grammage 20 g/m$^2$. FIG. 4 shows the results graphically, in the form of a plot of Smoothness Ranking R against top layer thickness X, expressed in gm$^{-2}$.

In both of Examples 1 and 2, the sheets with three plys of pulp A had a poorer surface than those made in a single ply, indicating that the improvement is not a result of making the sheets in plys.

EXAMPLE 3

Figure 5:
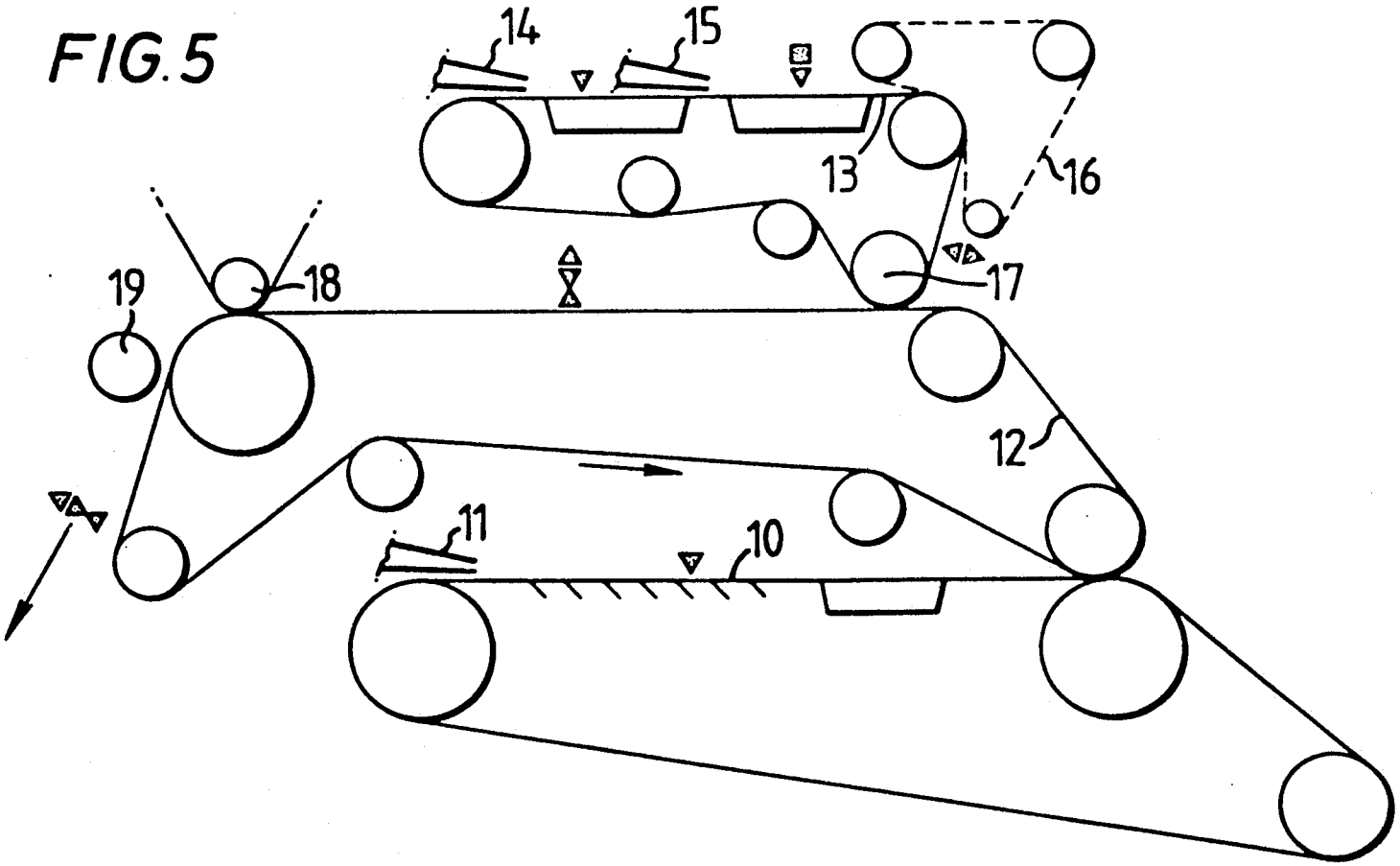
FIG. 5 is a schematic longitudinal vertical section of the wet end of Fourdrinier paper-making equipment used to make a multi-ply photobase paper web.

A multi-ply paper web was produced in trials using the wet-end equipment shown in FIG. 5.

In FIG. 5, a lower Fourdrinier wire 10 receives paper pulp A (furnish) from a first primary headbox 11. This will provide the "top" ply of the web. A pick-up felt 12 receives the web from the downstream end of the wire and carries it upwardly to an upper Fourdrinier wire 13 which has a second primary headbox 14 and a secondary headbox 15. Pulp from the primary headbox 14 constitutes the "bottom" ply of the web and that from the secondary headbox is of course the "middle" ply. In the trials, the same pulp composition B was supplied to both the upper headboxes 14 and 15. A top wire 16 drained some of the water from the two-ply web on the upper wire. The two-ply web merges with the lower single ply on the felt 12 at roller 17, and the merged three-ply web is carried by the felt 12 past first 18 and second 19 press rollers for conventional drying and coating.

A triangle device is used in FIG. 5 to denote a paper ply web with a "wire side" to it, being a downwardly-directed vertex of the triangle. Where there is no "wire side" a square device is used instead.

Pulp A was a relatively soft 67% "Strom" photo-grade sulphite/33% "Celbi" refined to 28° SR. Pulp B was Northwood sulphate "kraft" pulp refined to 24° SR. Pulp A was fed from the headbox at a rate which provided a top ply with a weight of around 40 $gm^{-2}$. The other two plies had a weight of around 55 $gm^{-2}$. Thus the three ply photobase (E) had a weight of around 150 $gm^{-2}$. In the "control" experiments (C) all three plies were of Pulp A, each at a weight of around 50 $gm^{-2}$.

The results of the trial are shown in Tables 4 and 5 below. No anomalous curl behaviour was found in the tested samples of experimental two-pulp paper. The amount of increase in stiffness was not as much as expected, but this may be because of an observed poor retention of fines in the pulp, so further development should lead to better results. Nevertheless, the results show that performance at least as good as conventional photo-base paper is achievable at a reduced raw material cost.

TABLE 4

| SAMPLE | (A) GRAMMAGE $gm^{-2}$ | (B) THICKNESS μm | (C) STIFFNESS (KENLEY) C/D | (C) STIFFNESS (KENLEY) M/D | $(C \div AB^2) \cdot 10^7$ CORRECTED STIFFNESS C/D | $(C \div AB^2) \cdot 10^7$ CORRECTED STIFFNESS M/D |
|---|---|---|---|---|---|---|
| E1 | 145.4 | | | | | |
| E2 | 144.5 | | | | | |
| E3 | 146.1 | | | | | |
| E4 | 148.7 | | | | | |
| E5 | 146.9 | | | | | |
| Mean | 146.5 | 170 | 1.2 | 2.0 | 2.8 | 4.7 |
| C1 | 148.0 | | | | | |
| C2 | 147.2 | | | | | |
| C3 | 145.5 | | | | | |
| C4 | 144.9 | | | | | |
| C5 | 145.4 | | | | | |
| Mean | 146.2 | 181 | 1.3 | 2.1 | 2.7 | 4.4 |

TABLE 5

| SAMPLE | RANKING ORDER BEST | RANKING ORDER WORST | AVERAGE |
|---|---|---|---|
| E1-5 | 1, 1 . . . 5 5 . . . 9 9 9 10 . . . | | 6.1 |

TABLE 5-continued

| SAMPLE | RANKING ORDER BEST | RANKING ORDER WORST | AVERAGE |
|---|---|---|---|
| C1-5 | . . . 2,3,4 5 5 5 6 7 7 8 . . . 11 | | 6.3 |

Notes on Tables 4 and 5

Samples E1-5 were from the experimental paper, with top ply of pulp A and other two plies of pulp B. Samples C1-5 were from a control paper in which all three plies were of pulp A. Assessment of smoothness and measurement of stiffness was carried out after resin coating W/S = wire side T/S = top side C/D = cross direction M/D = machine direction Kenley = the Kenley test for stiffness is well-known to those in the art. Results are expressed in units of grams force.

Figure 6:
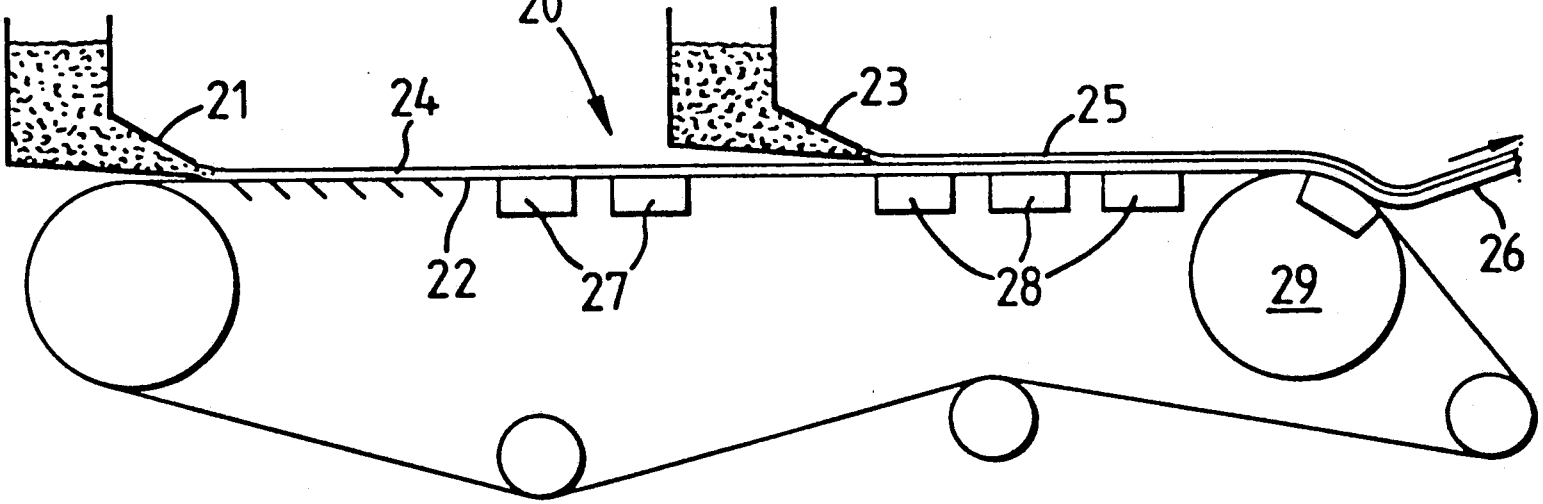
FIGS. 6 and 7 are similar sections of alternative equipment.

FIG. 6 shows an alternative, and simpler, arrangement using a single wire Fourdrinier machine 20 with two headboxes. The primary headbox 21 lays down on the wire 22 a single backing ply 24 of around 100 $gm^{-2}$ of a kraft paper pulp. Onto this backing ply, the secondary headbox 23 lays down a surface ply 25 of around 50 $gm^{-2}$ of a photographic grade paper pulp. The two-ply web 26 is taken from the wire 22 at a suction couch roll 29 and processed dried and coated in the conventional way.

Primary vacuum boxes 27 upstream of the secondary headbox bring the content of dry matter content of the backing ply 24 up to 15–16% before the surface ply is deposited on it. Secondary vacuum boxes 28 are provided downstream of the secondary headbox to draw water from the 2-ply web 26.

Figure 7:
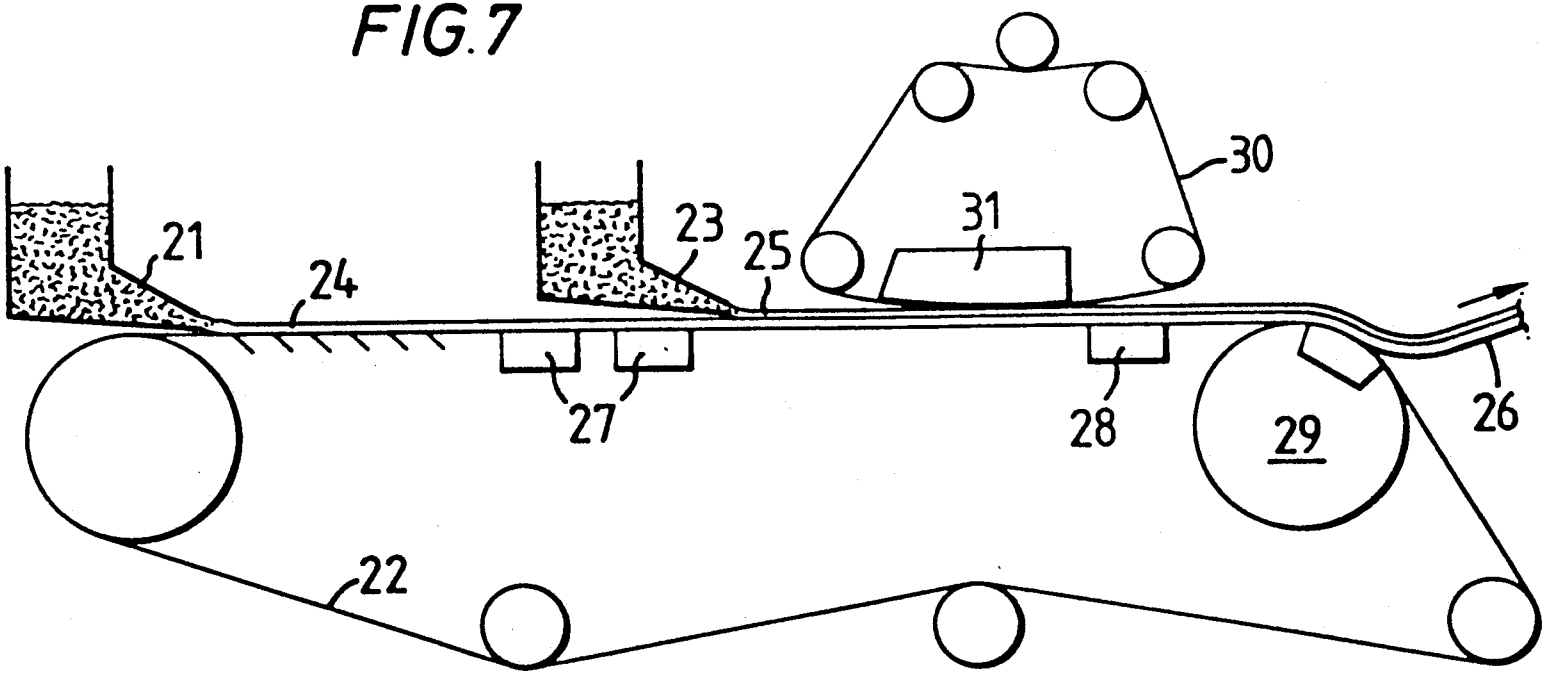

In the variation shown in FIG. 7, a top wire 30 and associated vacuum box 31, downstream of the secondary headbox 23, draws water from the top ply 25.

We claim:

1. A photographic base paper comprising a surface ply of photographic grade paper made of sulphite pulp, said surface ply having a wetness in the range of 25 to 35 on the Schopper-Riegler scale and at least one backing ply of a less expensive paper made of sulfate pulp, said backing ply having a wetness in the range of 19 to 24 on the Schopper-Riegler scale, wherein:

a) the weight of the surface ply is in a range of from 20 to 50 $gm^{-2}$;

b) the weight of the base paper is in the range of from 140 to 165 $gm^{-2}$;

c) the surface ply and the backing ply are each generated as a separate web, and the separate webs are merged together, while still wet, to create a single web of the said photographic base paper; and d) the surface ply and the backing ply are coated with a polyolefin coating.

2. A photographic base paper as claimed in claim 1, wherein the weight of the surface ply is in a range of from 20 to 30 $gm^{-2}$.

3. A photographic base paper as claimed in claim 2, wherein said polyolefin coating comprises first and second polyethylene layers coated on said surface ply and the outermost backing ply, respectively, and further comprising a photographic emulsion layer coated on said first polyethylene layer.

4. A photographic base paper as claimed in claim 3, wherein said at least one backing ply comprises kraft paper pulp.

5. A photographic base paper as claimed in claim 1, wherein said polyolefin coating comprises first and second polyethylene layers coated on said surface ply and the outermost backing ply, respectively.

6. A photographic base paper as claimed in claim 5, further comprising a photographic emulsion layer coated on said first polyethylene layer.

7. A photographic base paper as claimed in claim 1, wherein said at least one backing ply comprises kraft paper pulp.

8. A photographic base paper as claimed in claim 1, further comprising a photographic emulsion layer coated on said polyolefin coating.

9. A reflective photographic base comprising a paper web coated on each of its sides with a polyolefin layer, wherein the paper web has at least a surface ply formed from a pulp of relatively soft and deformable fibers, said ply having a weight of from 20 to 50 $gm^{-2}$, and a backing ply formed from relatively harder and less deformable fibers, said plies being brought together face to face in a Fourdrinier paper-making machine before drying to form a single web.

10. The photographic base as claimed in claim 9, wherein the backing ply is of kraft paper fibers.

11. The photographic base as claimed in claim 9, wherein the polyolefin layer coating the surface ply is pigmented with a white pigment.

12. The photographic base as claimed in claim 9, wherein the polyolefin is polyethylene.

13. The photographic base as claimed in claim 9, wherein the surface ply has a weight of from 20 to 30 $gm^{-2}$.

* * * * *